US006028259A

United States Patent [19]

Lombardi et al.

[11] Patent Number: 6,028,259

[45] Date of Patent: Feb. 22, 2000

[54] WEIGHTING OF DRUM PEDAL APPARATUS

[75] Inventors: Donald G. Lombardi; John J. Good, both of Thousand Oaks, Calif.

[73] Assignee: Drum Workshop, Inc., Oxnard, Calif.

[21] Appl. No.: 09/221,477

[22] Filed: Dec. 28, 1998

[51] Int. Cl.[7] ..... G10D 13/02

[52] U.S. Cl. ..... 84/422.1; 84/422.2; 84/422.3

[58] Field of Search ..... 84/411 R, 422.1, 84/422.2, 422.3

[56] References Cited

U.S. PATENT DOCUMENTS

| | | | |
|---|---|---|---|
| 1,343,164 | 6/1920 | Smith | 84/422.1 |
| 2,132,211 | 10/1938 | Hueckstead | 84/422.1 |
| 2,893,284 | 7/1959 | Washington, Jr. | 84/422.1 |
| 4,235,146 | 11/1980 | Purdy | 84/422.1 |
| 4,359,804 | 11/1982 | McNinch | 16/276 |
| 4,691,612 | 9/1987 | Smith | 84/422.1 |
| 4,691,613 | 9/1987 | Jacobson | 84/422.1 |
| 4,756,224 | 7/1988 | Lombardi | 84/422.1 |
| 5,105,709 | 4/1992 | Lombardi | 84/422.3 |
| 5,203,827 | 4/1993 | Nestrud | 74/594.5 |
| 5,627,332 | 5/1997 | Lombardi | 84/422.1 |
| 5,866,830 | 2/1999 | Onyszkanycz | 84/422.1 |

FOREIGN PATENT DOCUMENTS

WO 98/25258 6/1998 WIPO .

*Primary Examiner*—Robert E. Nappi
*Assistant Examiner*—Kim Lockett
*Attorney, Agent, or Firm*—William W. Haefliger

[57] ABSTRACT

A drum beating assembly includes a foot operated pedal having inertia weights carried to increase the drum striking force of the drum beater operatively driven by the pedal.

19 Claims, 13 Drawing Sheets

3
22c
21c
21a
22a
22
21
22b
21b
16
16b
16c
56a
61
58a
15
19
18
14
58c
54
42
60
59
49
21d
58b
19c
12a
22d
16a
56
17
11
46
12
35
41
31
13
10
3

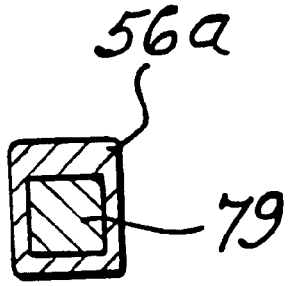
FIG. 4.
FIG. 5.
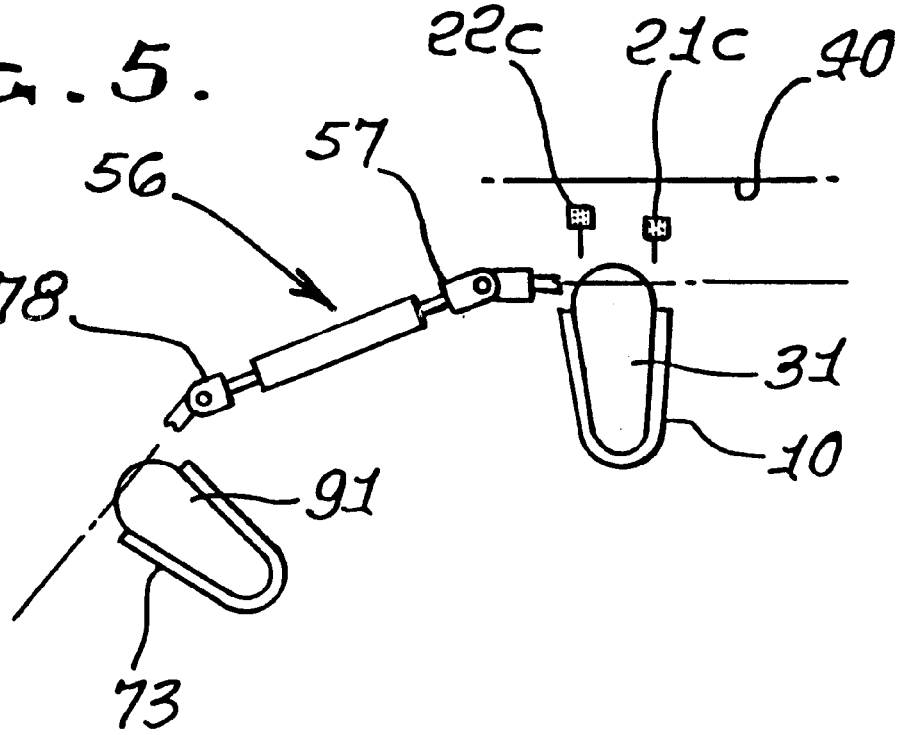

21
40
16
17
11
14
525
528a
520
530
522
524
523
531
102
10
110
13
40a

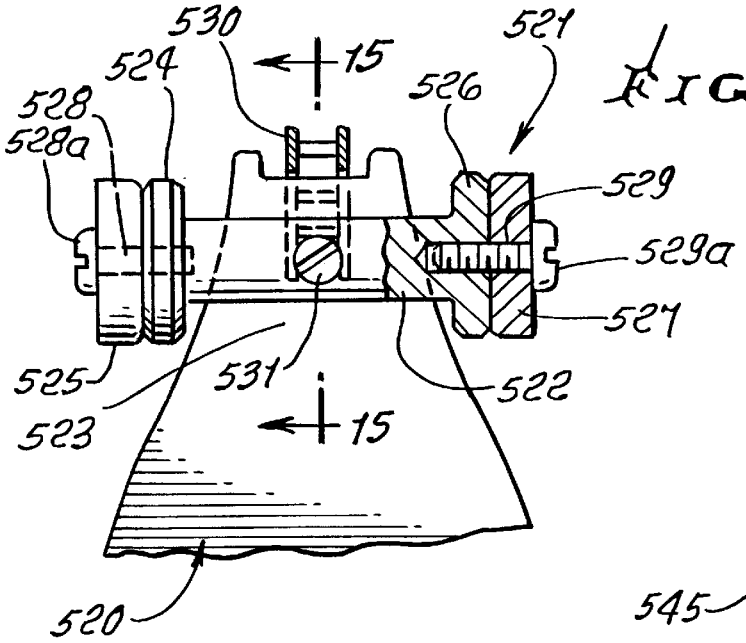
FIG. 14.
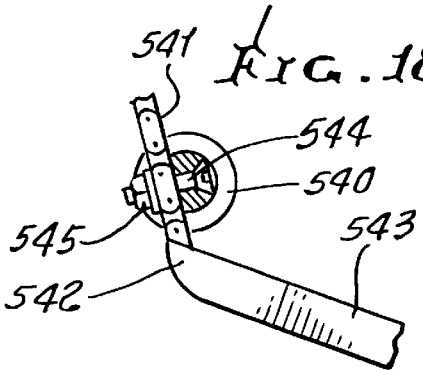
FIG. 18.
FIG. 16.
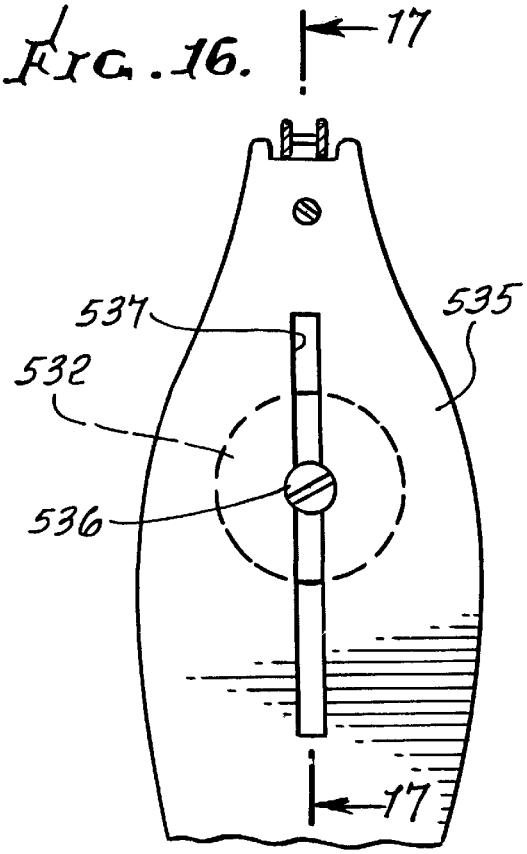
FIG. 17.
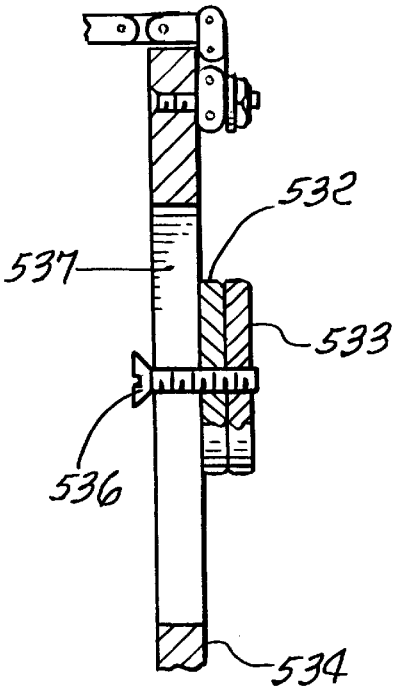

WEIGHTING OF DRUM PEDAL APPARATUS

BACKGROUND OF THE INVENTION

This invention relates generally to drum beating apparatus, and more particularly to increasing the drum striking force of the beater, driven by a pedal.

There is need for mechanism enabling creation of a louder sound when a beater strikes a drum, such as a bass drum; and in particular there is need for creation of this effect without the drummer having to apply to his foot all of the energy applied by the beater to the drum at the moment of impact.

SUMMARY OF THE INVENTION

It is a major object of the invention to provide improved drum beating apparatus meeting the above need and objectives. Basically, the invention is embodied in a combination of elements that increase momentum of the beater, when striking the drum, and that includes:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, in up and down directions, e) and at least one inertia weight carried by the pedal to move up and down with the pedal to increase the drum striking force of the beater.

As will be seen, the pedal has upper and lower sides, and the weight may project at either of such sides. For maximum or near maximum "throw" of the weight, transmitted to the beater as it strikes the drum, the weight is typically carried to project at or near the pedal forward end which undergoes maximum up and down movement.

Another object is to provide multiple of such inertia or balance weighting to be carried by the pedal.

Yet another object is to provide a weight carrier attached to the pedal, with multiple weights associated with the carrier and at least one weight selectively removable for weight balance adjustment.

An additional object is to provide for weight adjustable attachment to the pedal whereby the weight can be relatively positioned on and relative to the pedal. In this regard, the pedal may define a groove or slot along which the weight can be adjustably positioned to vary its inertia transmission effect upon the beater.

A further object is to provide the carrier to have bar-bell shape enabling one or more additional weights to be supported on the bar-bell.

Yet additional objects include the provision of roller bearing means supporting the pedal for pivoting, rearwardly of said balance weight; the provision of a heel pad on the plate, and a roller bearing assembly located in association with the heel pad at the rearward end of the pedal, and connected thereto to support the pedal for pivoting; and provision of two bearing lugs and tongues extending forwardly and rearwardly of said lugs to connect the bearing assembly to said heel plate and to said pedal, all rearwardly of the inertia weight on the pedal, as referred to.

A further object is to provide selective weights of tandem pedals, for relative added or enhanced impact of a drum, by the beaters.

These and other objects and advantages of the invention, as well as the details of an illustrative embodiment, will be more fully understood from the following specification and drawings, in which:

DRAWING DESCRIPTION

FIG. 4 is a section taken on lines 4—4 of FIG. 1;

FIG. 5 is a diagrammatic view showing relative adjustability of two pedals on two base plates, in association with two drum beaters which have fixed relative positions;

FIG. 14 is a section taken on lines 14—14 of FIG. 13 showing multiple weight selectively added to the pedal forward portion;

FIG. 16 is a plan view of a pedal showing weight position adjustability;

FIG. 17 is a section taken on lines 17—17 of FIG. 16;

FIG. 18 is a schematic elevation, showing a weight added to the chain near the pedal forward position.

DETAILED DESCRIPTION

Figure 1:
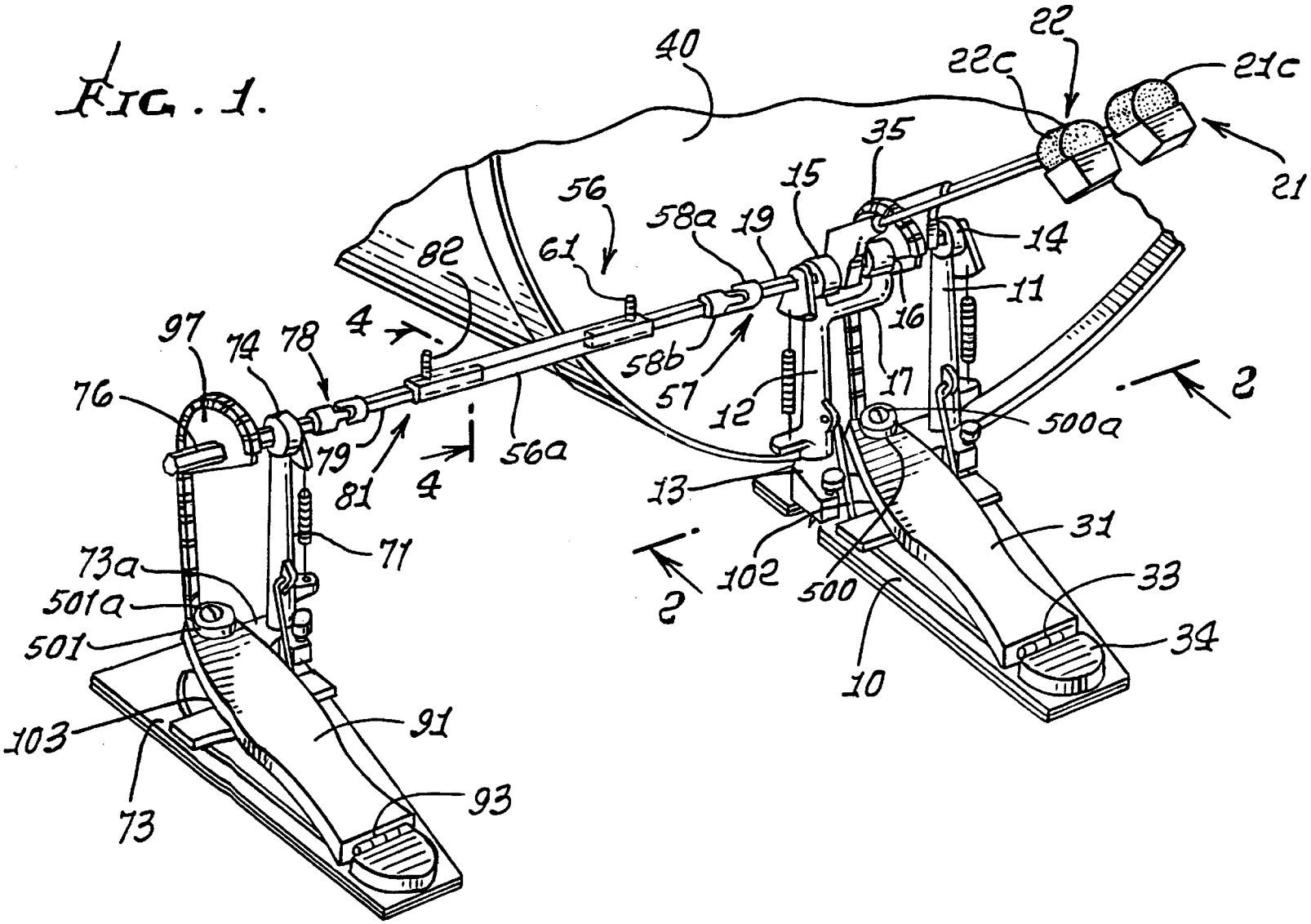
FIG. 1 is a perspective view of one preferred form of the apparatus incorporating the invention.

In the drawings, a first horizontal, longitudinally extending base plate 10 integrally supports a first frame that includes first pedestal means. Such pedestal means is shown to include laterally spaced, upright pedestals 11 and 12, the lower ends of which are carried by a bottom yoke 13 attached to a base plate forward portion. The upper ends of the pedestals carry first and second coaxial bearing sleeves 14 and 15, which are laterally spaced apart. The pedestal means also carries third bearing structure 16, and specifically, an arm 17 extends laterally rightwardly from pedestal 12, and upwardly, to support structure 16. The latter includes a bearing housing 16*a*, and tow roller bearing parts 16*b* and 16*c* positioned in housing 16*a*, in laterally spaced relation. Arm 17 is elbow-shaped and is integral with 12 and 16*a*. A primary axle or shaft 18 is carried by the first and third bearings, and specifically, by bearing sleeve 14 and bearing part 16*b*; and a secondary axle or shaft 19 is carried by the second and third bearings, and specifically, by the bearing sleeve 15 and bearing part 16*c*, the axles 18 and 19 being independently rotatable, yet coaxial.

A primary drum beater 21 is carried by the primary axle 18, and a secondary drum beater 22 is carried by the secondary axle 19, whereby the two beaters are separately operable. Note that the beater 21 has a shaft 21*a* and a connector 21*b* to axle 18; and beater 22 has a shaft 22*a* and a connector 22*b* to axle 19, both connectors laterally spaced, and located between the bearing sleeves 14 and 15 on the pedestals. See also the beater heads 21*c* and 22*c*. Axles 18 and 19 are polygonal to rigidly connect to the elements 21*b* and 22*b*.

A first pedal 31 is operatively connected to the primary axle 18 to rotate that axle and the primary beater 21 in response to pedal pivoting effected by the foot of the drummer.

Figure 3:
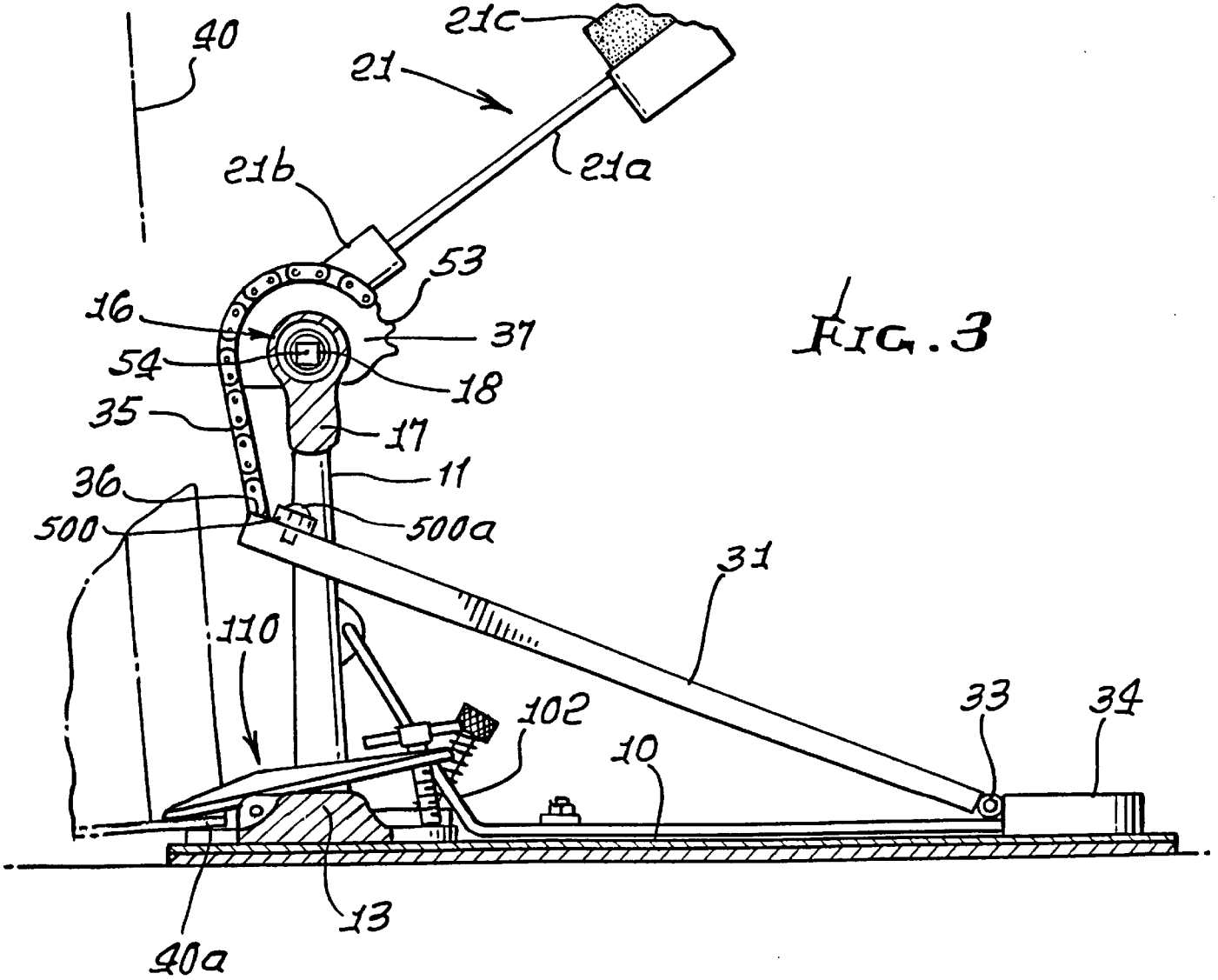
FIG. 3 is a section taken on lines 3—3 of FIG. 2.

In the FIG. 3 example, the pedal is pivoted at 33 to a heel support 34 attached to plate 10. Pivot 33 typically comprises roller beating means, such as ball bearings, to reduce friction. A flexible coupling, such as chain 35, is connected at 36 to the forward end of the pedal, and extends upwardly to mesh with and wrap on sprocket 37. The latter is fixedly mounted on axle 18, whereby, as the pedal is pushed down, the sprocket and axle 18 are rotated, and the beater 21 rotates forwardly, so that head 21*c* strikes the drum surface indicated at 40. Yieldable mans, such as tension spring 41 is operatively connected between the primary axle and the frame, such as the lower end of pedestal 11, to yieldable resist axle rotation, and return the beater to FIG. 3 position. Note that spring 41 has its upper end connected to crank 432 on shaft or axle 18.

A similar spring 46 is operatively connected between secondary axle 19 and the frame, such as the lower end of pedestal 12, to yieldably resist axle 19 rotation, to return secondary drum beater 22 to retracted position, as indicated in FIG. 3. That spring has its upper end connected to a crank 49 on shaft 19.

Axles 18 and 19 may have square cross sections to enable positive connection of the sleeve-type connectors 21*c* and 22*c* to the axles, set screws 21*d* and 22*d* also being provided. Annular bearings receive the axles for reception in the bearing sleeves 14 and 15.

The surface portions, including teeth 53 on the sprocket 37, may be located at progressively increasing radii from an axis 54 defined by axle 18, and located angularly about that axis, whereby those surface portions extend eccentrically relative to axis 54, as disclosed in U.S. Pat. No. 4,756,224. This causes the beater to travel progressively faster toward the drum surface, as the pedal is displaced downwardly at a fixed angular velocity.

The secondary axle 19 and secondary drum beater 22 may be rotatable by auxiliary means not mounted on plate 10. Such secondary means may, for example, include an elongated and elongatable rotary link 56 coupled to axle 19, as by coupling structure 57. The latter is shown to include universal joint members 58*a* and 58*b* rotatably interconnected by cross pin 58*c*. Member 58*a* is connected to the end 19*c* of axle 19 projecting away from the bearing 15; and member 58*b* is connected to a square section sub-shaft 59, as by transverse pin 60. Shaft 59 is also received in and connected to link member 56*a* via a coupling set screw 61, allowing extension of 56*a* and 59.

Figure 2:
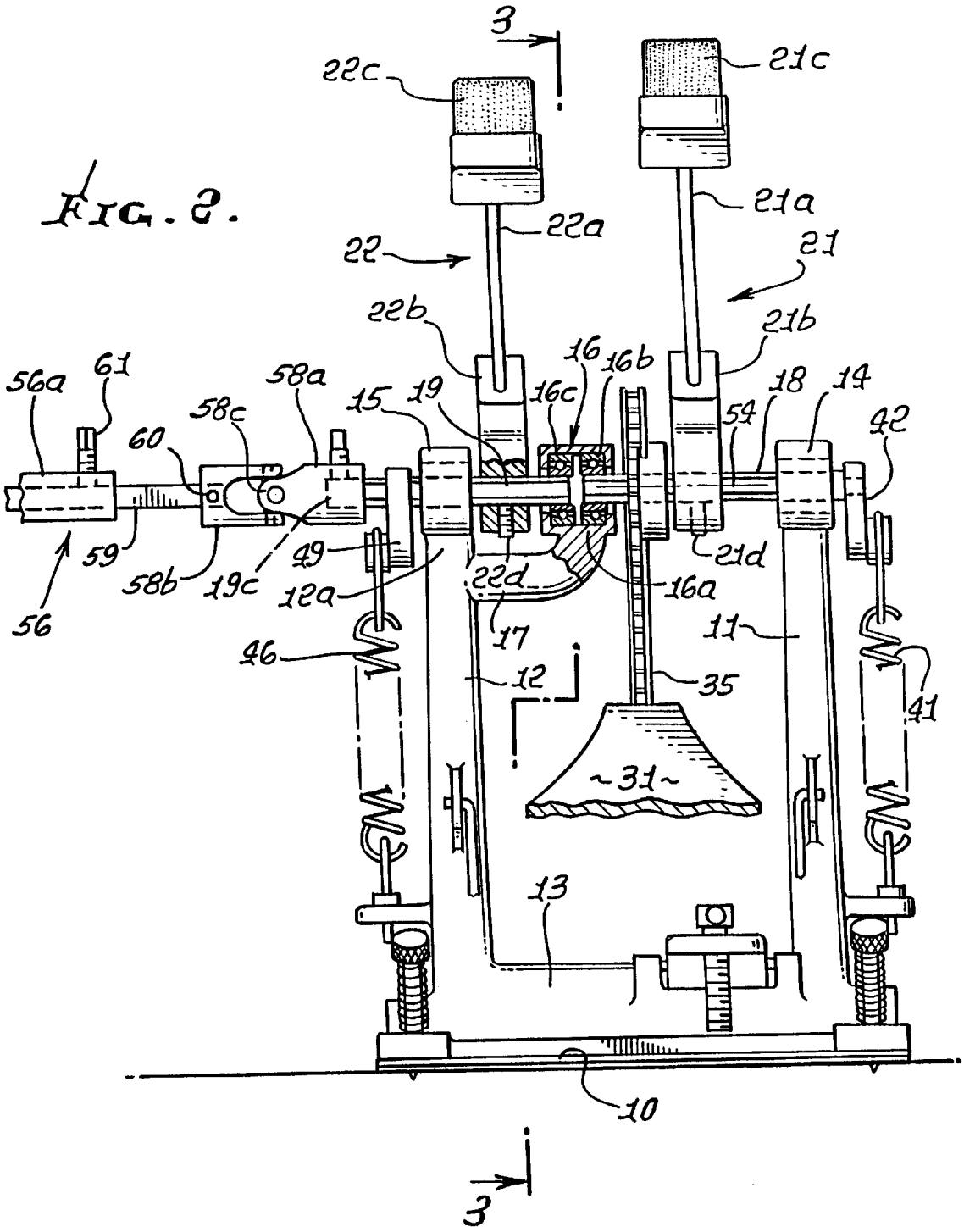
FIG. 2 is an enlarged section taken in elevation on lines 2—2 of FIG. 1.

Note that bearing 15 is coaxial with bearing 16, and carried by upper extension 12*a* of the pedestal. That upper extension 12*a* and arm 17 form a yoke, and between which beater 22 connector 22*b* is located. The two bearings 16*b* and 16*c* being separate may allow for some degree of axial misalignment of the axles 18 and 19, whereby each axle 18 and 19 is freely supported for rotation by only two bearings, yet the two beaters are located in close lateral relation, as seen in FIG. 2. Arm 17 is located above the pedal 31 so as not to interfere with it.

Figure 6:
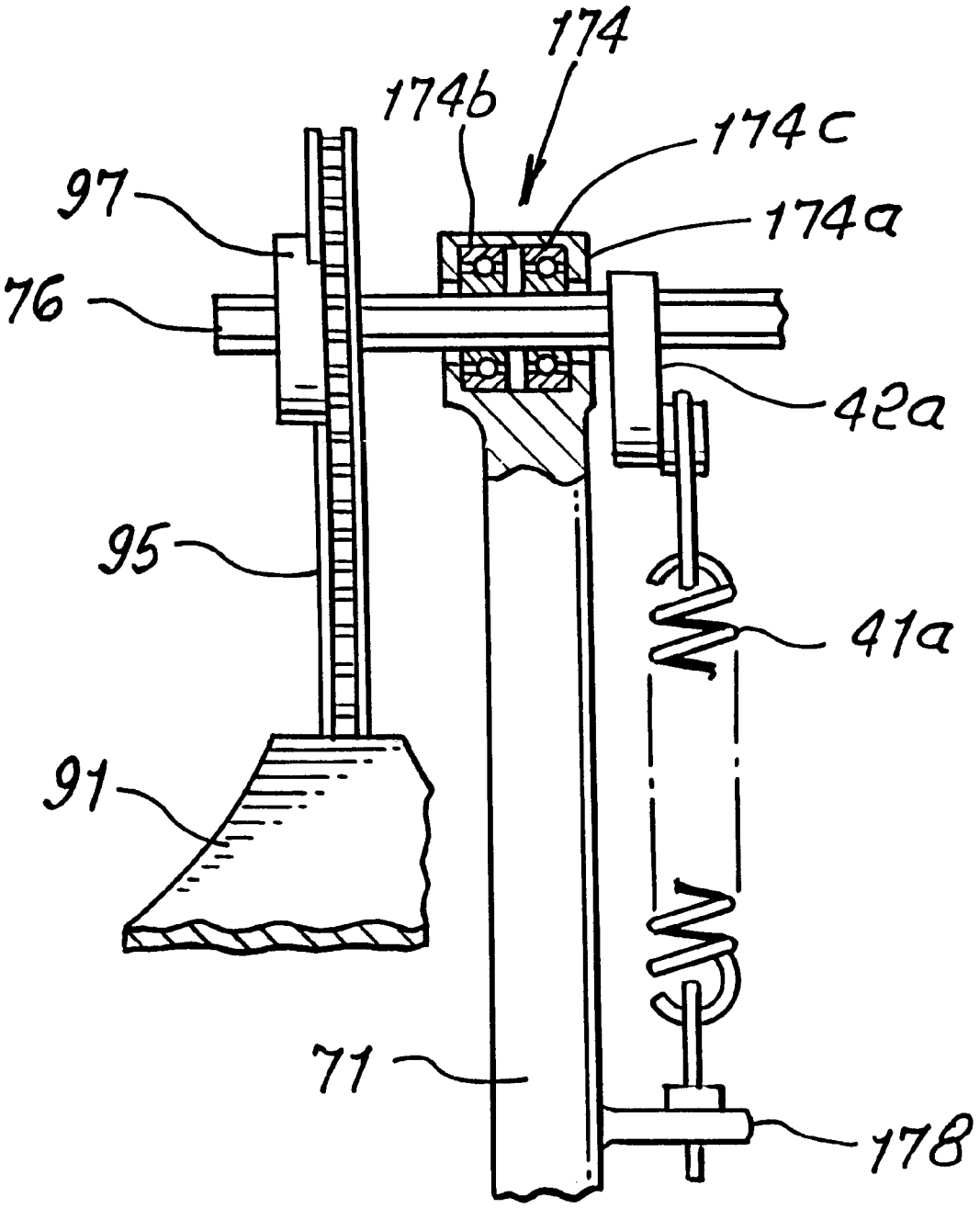
FIG. 6 is a fragmentary frontal view of the auxiliary pedal and single pedestal carrying the tertiary shaft.

FIGS. 1 and 6 show the provision of a second frame, including second pedestal means, such as single, upright pedestal 71. The latter is integrally mounted via bottom support 73*a* on a second base plate 73 which is independent of plate 10 and can be adjustably positioned at different locations relative to plate 10, to suit the drummer. See FIG. 5. Other bearing structure is carried by the second pedestal 71, and a tertiary axle or shaft 76 as by structure corresponding to structure 57. See for example universal joint 78, square cross section sub-shaft 79, and elongatable coupling 81. Set screws 82 and 61 are associated with the couplings 61 and 56 to adjustably grip the sub-shafts, allowing complete disassembly or disconnection of the two axles 19 and 76, and the two base plates 10 and 73. Elongated link member 56*a* advantageously consists of lightweight metal, such as aluminum.

A pedal 91 is pivotally mounted at 93 on second base plate 73, and a flexible coupling, such as a chain 95, couples the forward end of the pedal 91 to a sprocket 97 attached to axle 76. Accordingly, the pedal 91 is coupled to the second beater 22 to rotate same, as pedal 91 is pushed downwardly. Plate or sprocket 97 may be eccentric, as described above, as respects sprocket 37. Holder members 102 and 103 also support the pedestals on the base plates, as shown.

As shown in FIG. 6, the bearing 174 includes a housing 174*a* and two roller bearing parts 174*b* and 174*c* positioned in housing 174*a*, in laterally space-apart relation. Single pedestal 71 supports bearing 174. A tension spring 41*a* and crank 42*a* are connected between the shaft 76 and lug 178 on the pedestal, to yieldably and resiliently return the shaft 76 and pedal 91, and beater 22, to initial rotary positions.

Accordingly, the beater apparatus in one of its aspects provides a first pedal frame with rotatable first and second beaters and a first pedal for rotating the first beater when pushed down; a second pedal frame being provided with a second pedal; the second beater having a supporting shaft operatively connected to the second pedal; and characterized in that the first pedal frame is provided with first, second and third bearing portions, the first beater having a first supporting shaft supported by the first and second bearing portions, the second shaft supporting the second beater being supported by the second and third bearing portions, whereby the second shaft is rotatable independently of the first shaft. There is also an additional shaft coupled to one of the first and second shafts, and a single pedestal on the second pedal frame and being the only pedestal supporting the additional shaft, saving weight and providing added space or room for other percussion equipment close to the drummer. A very simple adjustable pedal structure is thereby provided.

Adjustable clamp means 110 on the forward end of the plate 10 clamps to drum structure 40*a*, as shown.

Figure 7:
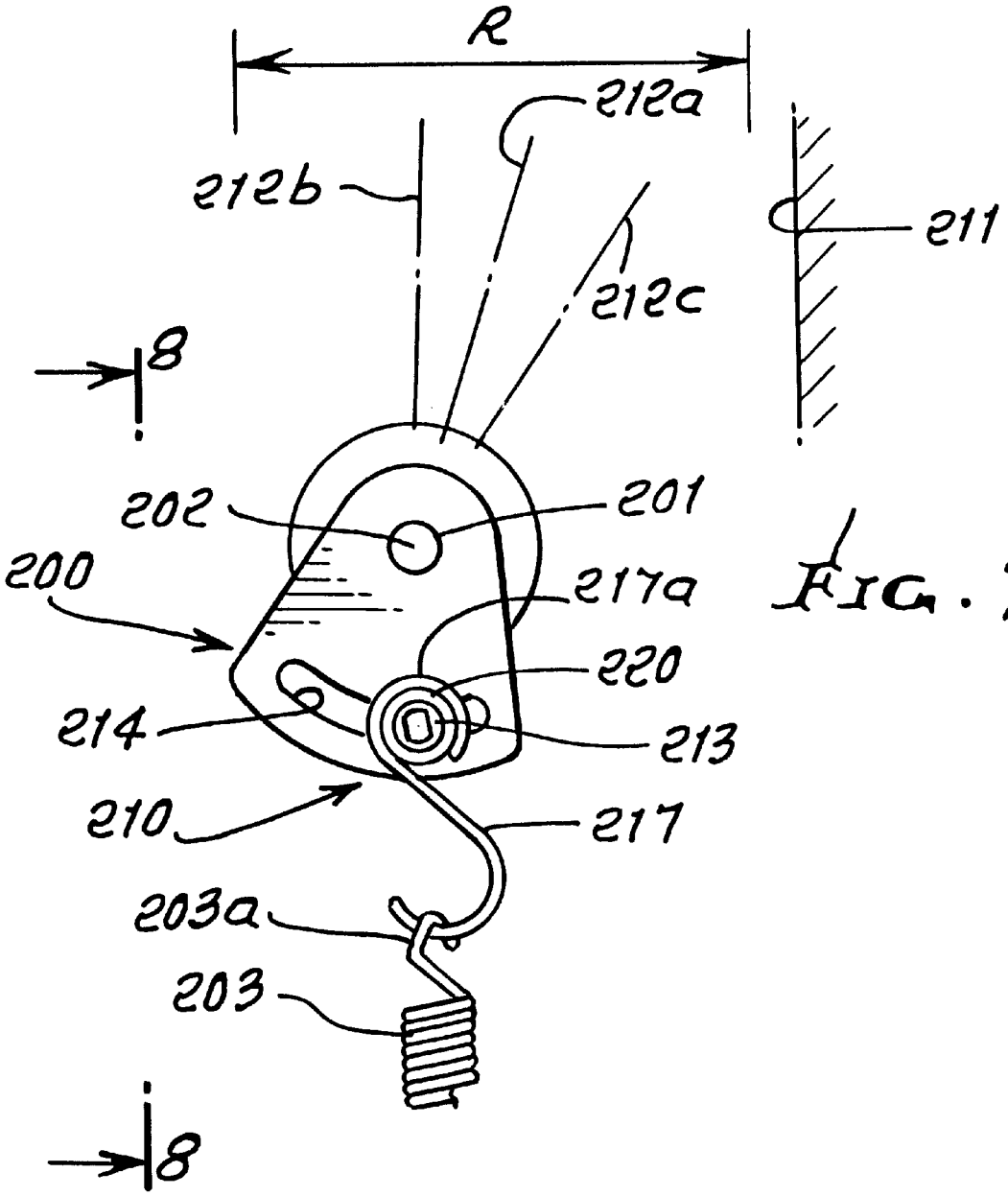
FIG. 7 is an enlarged side elevation showing an infinitely adjustable connection.
Figure 8:
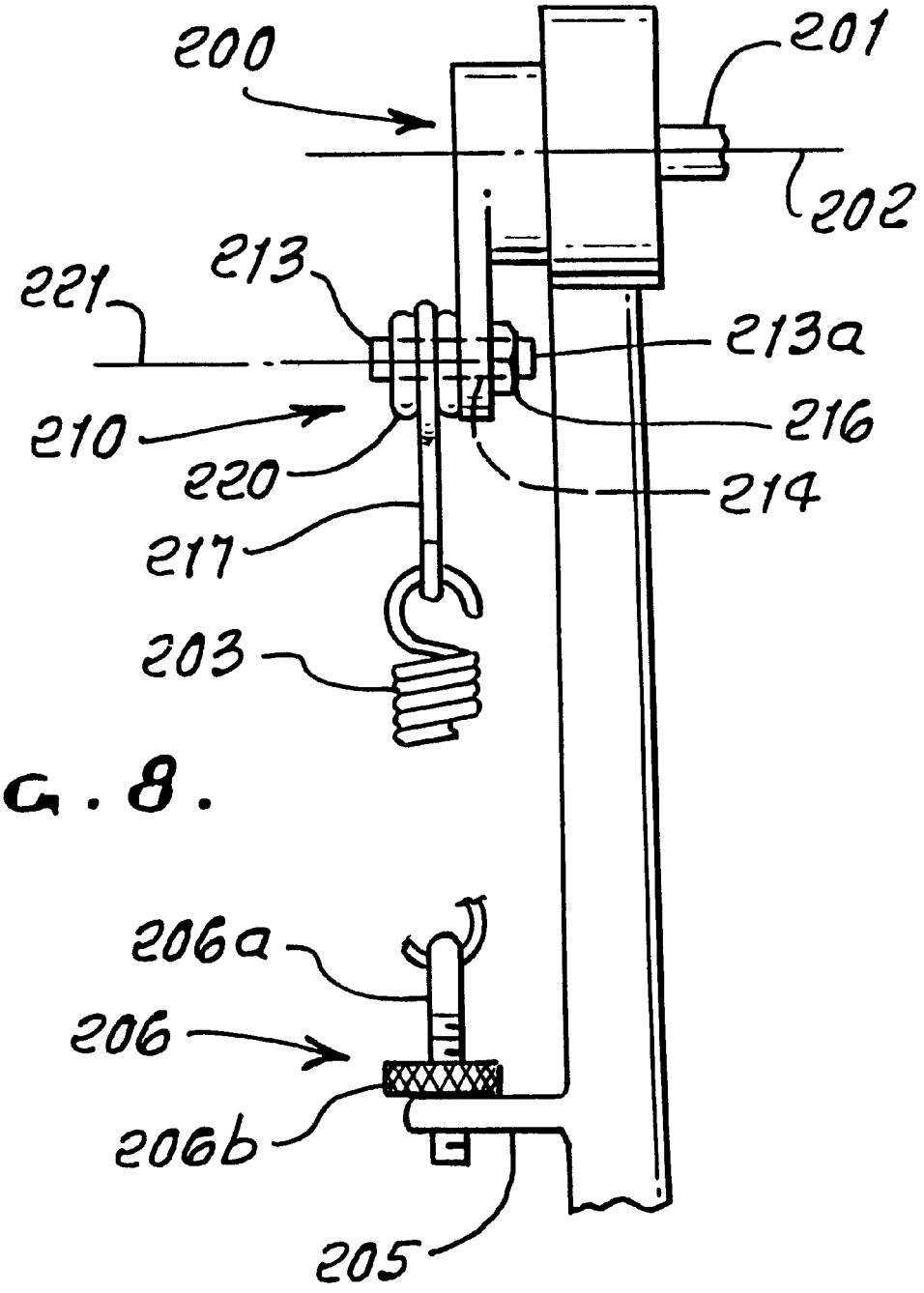
FIG. 8 is an elevation taken on lines 8—8 of FIG. 7.

Referring now to FIGS. 7 and 8, one or more of the cranks 42, 49 and 42*a* may have the form shown at 200, the axle to which the crank is connected indicated at 201, and the axes of axle and crank rotation being shown at 202. The return (tension) spring acting on the crank is shown at 203, and may represent any of the springs 41, 46, and 41*a*. One end of the spring is adjustably anchored to the pedal frame, indicated at 205. See threaded vertical axial adjustment 206 provided by a threaded shank 206*a* and an adjustable clamping nut 206*b*, whereby spring tension may be adjusted.

An infinitely adjustable or variable connection is provided between the crank and the tension spring, as generally indicated at 210. Its purpose is to allow accurate, for example infinitely adjustable, at-rest positioning of the drum beater carried by the shaft 201, and relative to a drum surface indicated at 211. See for example the different at-rest positions of the beater at 212*a*, 212*b*, 212*c*, etc. in FIG. 7, and to which the beater may be adjusted. An infinite number of such beater positions may be selected within a selected range indicated, for example, by the dimension R.

The illustrative connection 210, which is preferred but of which there may be variations, include a tongue in the form of a fastener 213 having a shank 213*a* passing into or through a groove or slot 214 in the crank. Slot 214 is endwise elongated in a arcuate direction about axis 202, and so that fastener shank 213*a* may be shifted to any one of an infinite number of positions along the slot length. A nut 216 on a threaded portion of the shank 213*a* may be tightened to clamp, i.e., connect the fastener in selected position (about axis 202) to the crank. This fixes the point of spring force transmission to the crank, since the spring is attached to the fastener, as shown, via a hook 217 hook-shaped attached to spring end 203*a*, and the at-rest angularity of the crank and the beater are thereby selected. Loosening of the nut allows adjusted connection of the spring to the crank, as referred to.

A bearing, as for example a ball bearing unit 220, is carried by the fastener, to have its axis 221 in coincidence with the fastener shank axis, i.e., parallel to axis 202. The hook end 217*a* fits over the bearing, as shown.

Figure 9:
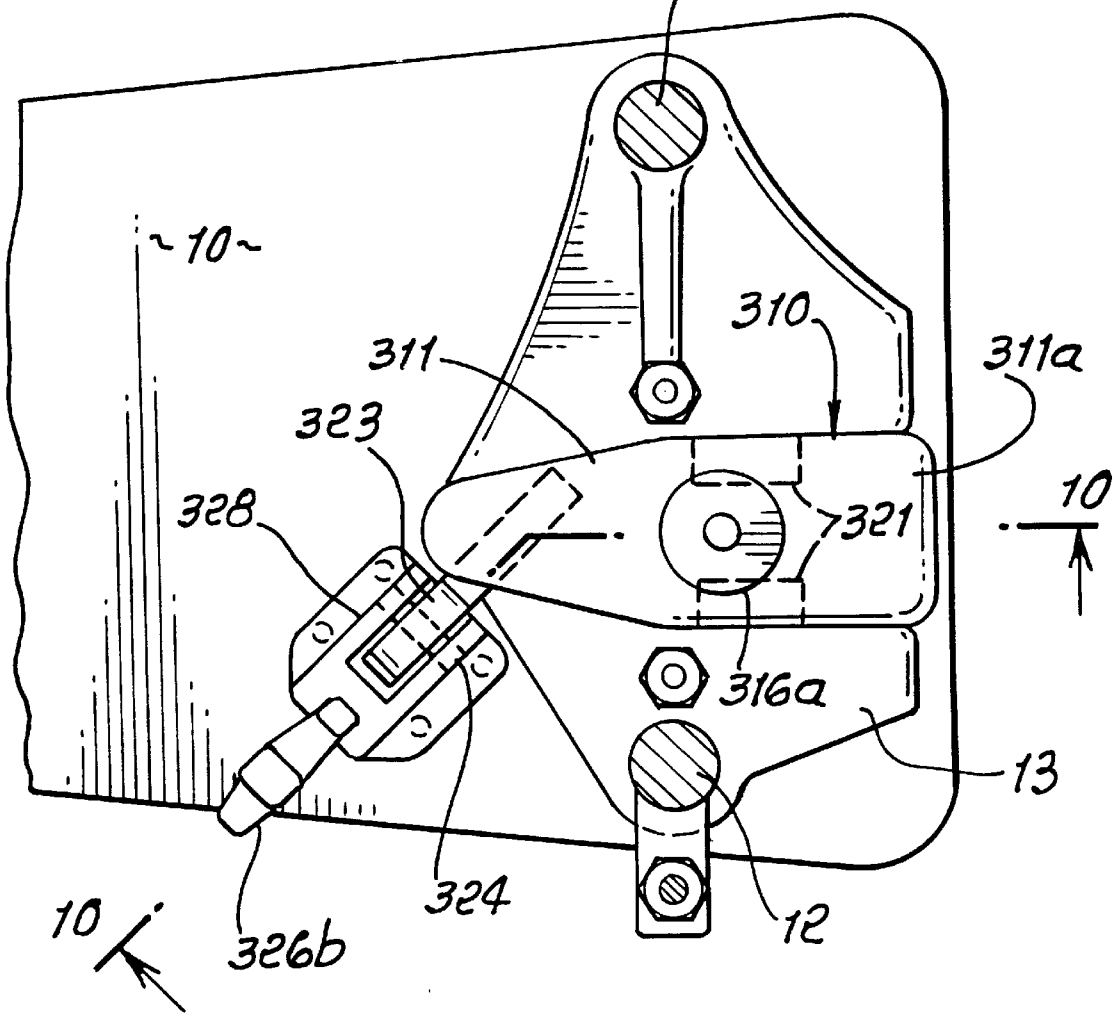
FIG. 9 is a top plan view of drum rim clamp adjustment apparatus.
Figure 10:
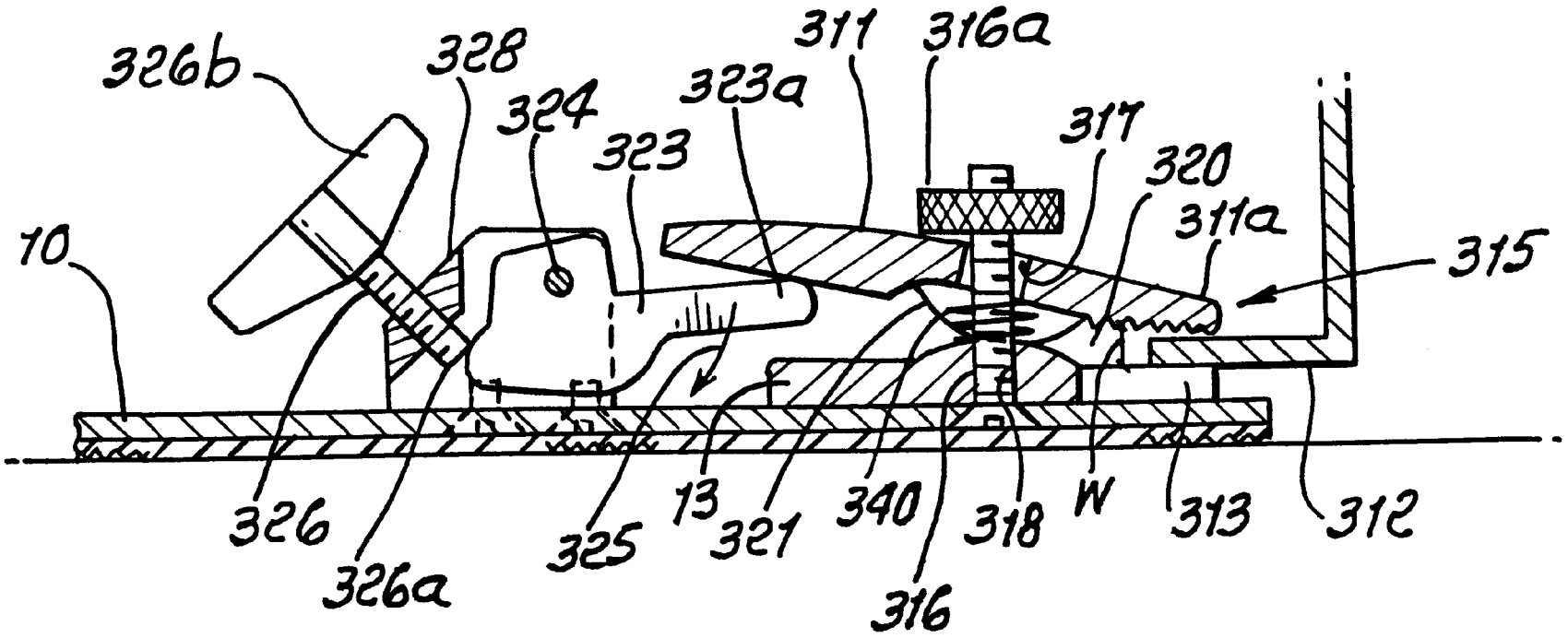
FIG. 10 is a section taken on lines 10—10 of FIG. 9.

In FIGS. 9 and 10, the means 310 to attach the base plate and pedal unit to a base drum rim corresponds to the previously shown such means 110 in FIG. 3. The base plate 10 and beater pedestal yoke 13 are the same as in FIG. 3. The clamp arm 311 has a forward end 311*a* adapted to project over the drum rim 312, and clamp it down against surface 313, associated with plate 10.

Means is provided to support arm 311 on the plate to pivot in a vertical plane, as indicated by arrow 315 in FIG. 10. Also, an adjustable member, such as screw fastener 316, is adapted to position the clamp arm 311 to pivot, as shown. Fastener 316 loosely projects with clearance downwardly through an opening 317 in arm 311, and into a threaded opening 318 in part 13, to allow turning of the fastener via knob 316*a* to adjust the height or level of the arm 311, relative to the base plate, but without preventing rocking or pivoting of the arm, as referred to. The width W of gap 320 is thereby adjusted. A rocker 321, or rockers, are integral with the arm 311, and project downwardly, as shown. A spring 340 urges arm 311 upwardly.

Also provided is another adjustable member 323 to control or adjust the pivot position of the arm 311 relative to the base plate and drum rim in gap 320. Member 323 is shown in the form of a lever pivoted at 324 to rock in a vertical plane, as indicated by arrow 325.

An adjustable set screw 326 bears at 326*a* against the lever to cause its end 323*a* to rise, effecting clamping of the drum rim as the set screw is tightened, as via turning of knob 326*b*. Structure 328 supports the screw, and the pivot at 324.

It will be seen that fastener 316 can be adjusted, so that only one or two turns of knob 326*b* are required to effect the rim clamping, which is of considerable advantage to minimize adjustment, in setting up the pedal apparatus to clamp to a bass drum. End-to-end located levels 311 and 323 are selectively angled, as seen in FIG. 9, for ease of access to adjustment know 326*a*.

Figure 11:
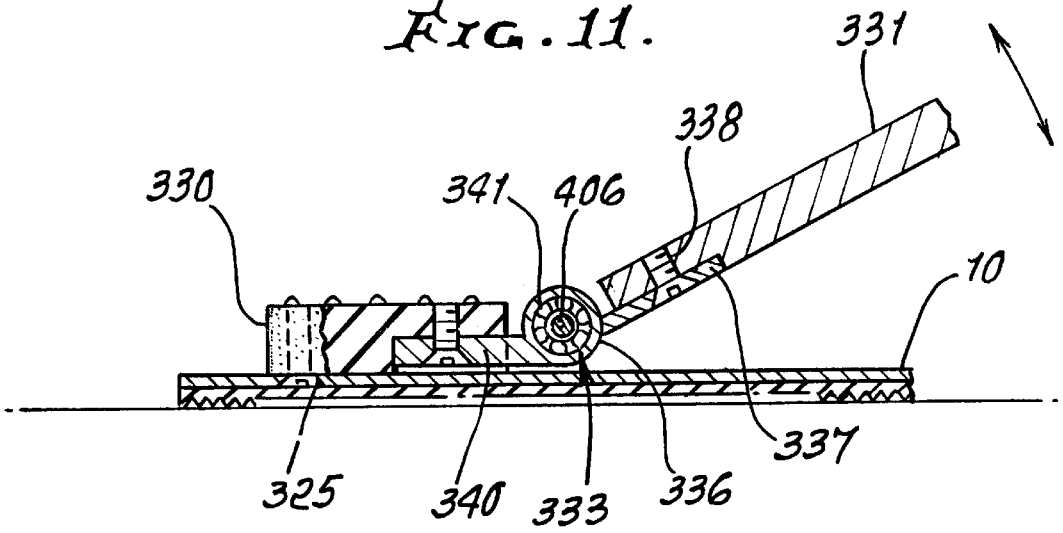
FIG. 11 is a vertical section through roller bearing support means for a pedal.

FIG. 11 shows provision of a heel pad 330 (corresponding to pad 34) attached at 325 to the plate 10. The rearward end of the pedal 331 is spaced forwardly of the pad. A roller bearing assembly 333 is located in association with the heel pad and the rearward end of the pedal, and connected thereto, to support the pedal for pivoting. See bearing housing 336 having an integral arm 337 attached at 338 to the underside of the pedal; and a bearing hub 339 having an integral arm 340 projecting into the heel plate and attached thereto. Bearing balls or rollers 341 are located in a ring, between inner and outer races defined by 336 and 339.

Figure 12:
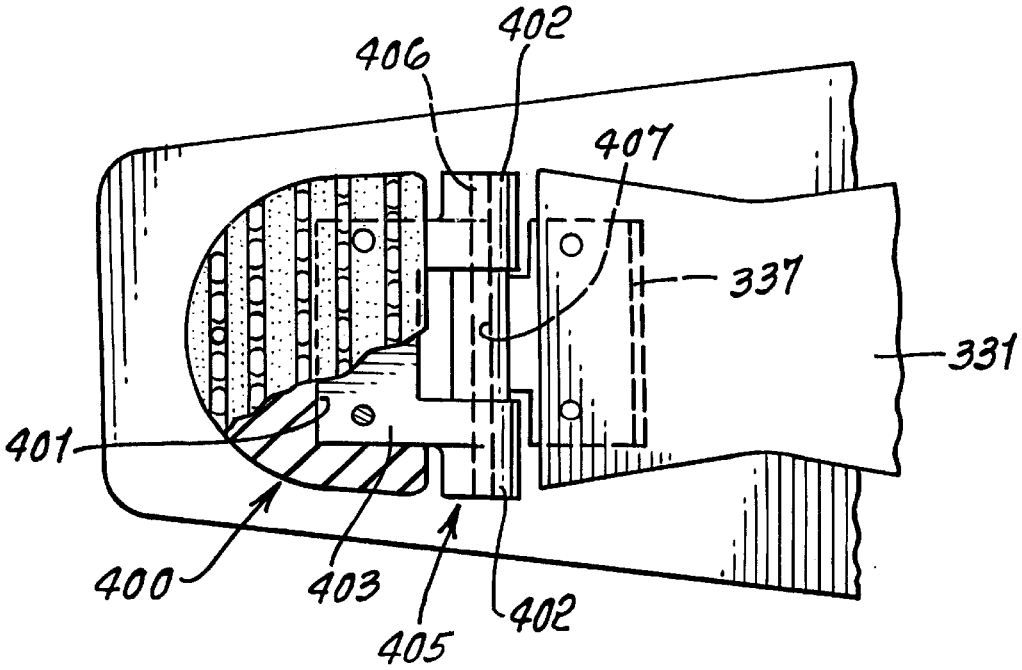
FIG. 12 is a top plan view of a modified bearing support.

FIG. 12 shows a modification in which the heel plate 400 has a recess 401 between two laterally spaced lugs 402. A tongue 403, attached to 402, is received in that groove. Ball bearings are housed between inner and outer races, received in the lugs, these assemblies indicated at 405. A bearing axle 406 is carried by the races, and a tongue 406*a* associated with axle 406 extends between lugs 402 and is carried by arm 337 attached to the heel plate. Axle 406 rotates in the bearings, as the pedal is swung by the drummer's shoe.

In FIG. 1, weights 500 and 501 are added to the forward portions of the pedals 31 and 91, to create the advantageous effects discussed above. Such weights may be removably attached to the pedals, as by removable fasteners 500*a* and 501*a*. At least one inertia weight is provided to move up and down with the pedal to increase the drum striking force of the beater. Thus, either or both of the pedals can be weighted, to produce a greater beater impact sound when striking the drum, according to which beater pedal has the added weight. In this embodiment, the weight is carried at the upper side of the pedal. See also FIG. 3. The weight may consist of various material, as for example steel, alloy steel, tungsten, etc. The pedal itself may consist of lighter weight material, such as aluminum or magnesium.

Figures 13, 15:
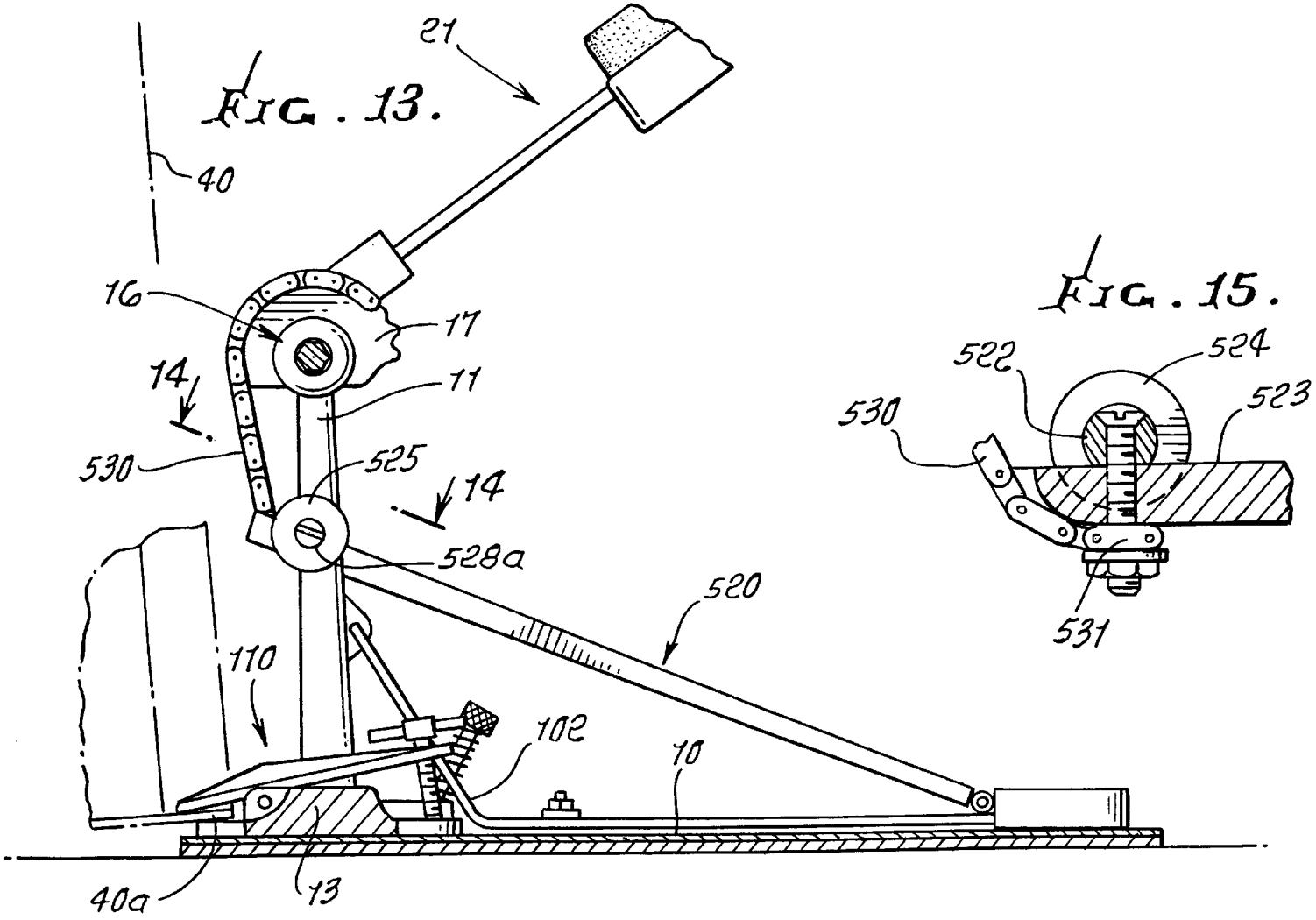
FIG. 13 is a view like FIG. 3, showing a weight at one side of the pedal forward portion.
FIG. 15 is a section taken on lines 15—15 of FIG. 14.

FIGS. 13 and 14 show a pedal 520 having a weight system 521 at its forward portion. A weight carrier shaft 522 is attached to the pedal forward portion 523; two weights 524 and 525 are carried by the carrier at the left side of the pedal forward narrowed portion; and two weights 526 and 527 are carried by the carrier at the right side of the pedal forward narrowed portion. Screw fasteners 528 and 529 are adjustably attached to the ends of the carrier, and have heads 528*a* and 529*a* that retain the selectively employed weights. Weights 524 and 526 are integral with the carrier. Weights 525 and 527 are relatively removable, in which case the associated fastener is removed. More weights can be added, using larger fasteners. The chain 530 attachment to the pedal forward portion, is shown at 531, between weights at opposite ends of the carrier. See FIG. 15.

FIGS. 16 and 17 show weights 532 and 533 attached to the underside 534 of a pedal 535, as by a holding fastener 536. The fastener extends through a slot 537 extending medially and lengthwise of the pedal plate 535. The fastener can be loosened, and shifted to a selected position lengthwise of the slot, to selectively position the weight or weights along the pedal. The fastener has threaded attachment to the weights.

In FIG. 18, the weight 540 is attached to the end portion of the beater shaft drive chain 541, near the forwardmost extent 542 of the pedal 543. A fastener and nuts 544 and 545 attach the weight to the chain.

Figure 19:
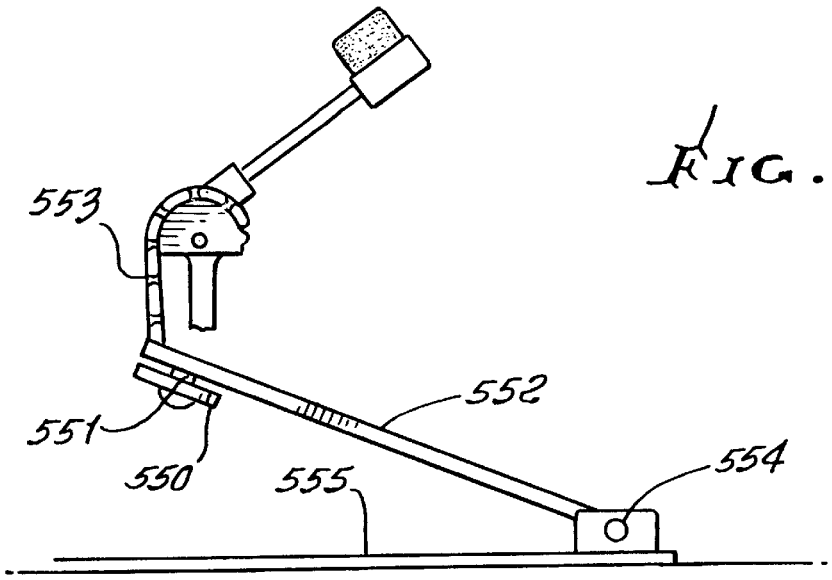
FIGS. 19–22 are schematic views showing different weightings of the pedal forward portion.

FIG. 19 shows a weight 550 attached at 551 to the underside of the pedal 552 below the chain 553. A roller bearing support for the opposite end of the pedal appears at 554, and a base-plate at 555. A spring, not shown, returns the pedal to up-position, so the spring and weight interact during play, as by downward momentum of the weight tending to tension the spring to greater extent. Numeral 552 also indicates the zone for reception of the drummer's foot.

Figure 20:
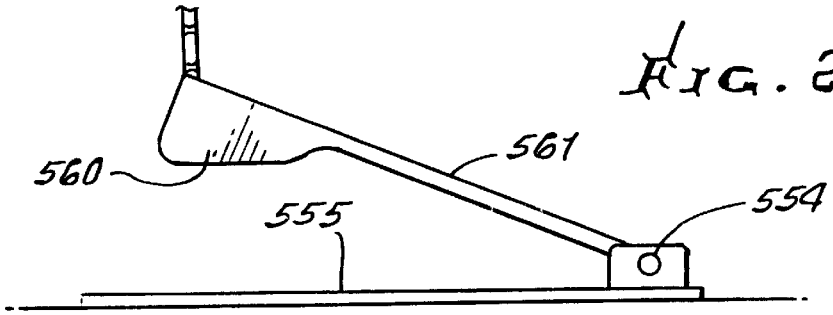
Figure 21:
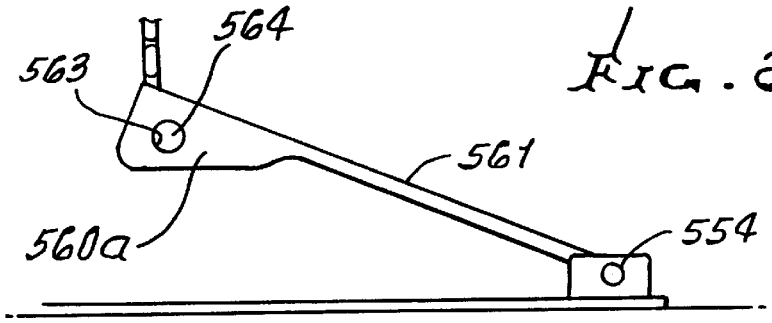

FIG. 20 shows weighting 560 at the underside of the pedal 561 forward end. Such weighting may consist of an integral enlargement of the pedal, as formed, and shown. In FIG. 21, the enlargement 560*a* has a drilled opening 563, in which a heavier weight, such as tungsten 564 is received. Numeral 561 also indicates the zone for reception of the drummer's foot.

Figure 22:
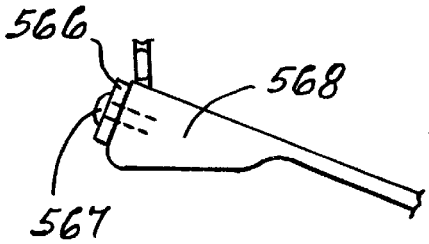

In FIG. 22, a weight 566 is attached at 567 to the forward end of the enlargement 568 at the pedal forward end.

We claim:

1. A drum beating assembly, comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, e) and multiple inertia weights carried by the pedal to move with the pedal to increase the drum striking force of the beater.

2. The assembly of claim 1 wherein the pedal has upper and lower sides, and at least one weight projects at said upper side of the pedal.

3. The assembly of claim 1 wherein the pedal has a forward end that undergoes maximum up and down movement, said weights carried to project proximate said pedal forward end.

4. The assembly of claim 3 wherein the pedal has upper and lower sides, and said weights project proximate said upper side of the pedal.

5. The assembly of claim 1 wherein the pedal has upper and lower sides, and said weights project proximate said lower side of the pedal.

6. The assembly of claim 1 wherein said pedal has opposite sides which are laterally spaced apart, at least one of said weights carried at one of said opposite sides.

7. The assembly of claim 1 including a weight carrier attached to the pedal, and said multiple weights are carried so that at least one weight is relatively removable from the carrier, for balance weight adjustment.

8. The assembly of claim 1 including roller bearing means supporting the pedal for pivoting, rearwardly of said inertia weights.

9. The assembly of claim 1 including a heel pad, and a roller bearing assembly located in association with the heel pad at the rearward end of the pedal, and connected thereto to support the pedal for pivoting.

10. The assembly of claim 9 including two bearing lugs and tongues extending forwardly and rearwardly of said lugs to connect the bearing assembly to said heel pad and to said pedal.

11. The assembly of claim 9 including fasteners rearwardly connecting the heel pad to a base plate defined by the frame.

12. The assembly of claim 1 wherein the weights have adjustable attachment to the pedal whereby the weights can be relatively positioned on and relative to the pedal.

13. The assembly of claim 1 wherein said pedal defines a groove along which at least one weight can be adjustably positioned.

14. The assembly of claim 7 wherein the carrier has bar-bell shape.

15. The assembly of claim 14 wherein at least one additional inertia weight is removably supported on the bar-bell shape carrier.

16. A drum beating assembly comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, the pedal having a forward portion, e) the frame including a base plate, there being a clamp arm to clamp a drum rim, means supporting the arm on the plate to pivot relative thereto, and a first adjustable member located to pivot said arm as said member is moved, f) and multiple inertia weights acting on the pedal forward portion, during drum beating.

17. A drum beating assembly, comprising:

a) two pedals operable to effect drum beating by two beaters rotatable about a common axis, b) and multiple inertia weights acting on at least one of the two pedals, during said drum beating, to increase drum striking force of at least one beater.

18. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, in up and down directions, e) and at least one inertia weight carried by the pedal to move with the pedal to increase the drum striking force of the beater, f) the pedal defining a zone for reception of the drummer's foot, g) there being multiple of said weights, which are adjustably positioned in association with the pedal, so that the multiple weights occupy different locations that are spaced from said zone.

19. In a drum beating assembly, the combination comprising:

a) a frame, including at least one pedestal, b) an axle carried by the pedestal to rotate relative thereto, the axle having an axis of rotation, c) a drum beater carried by the axle, d) a pedal operatively connected to the axle to rotate the axle and beater in response to pedal movement, in up and down directions, e) and at least one inertia weight carried by the pedal to move with the pedal to increase the drum striking force of the beater, f) the pedal defining a zone for reception of the drummer's foot, g) there being multiple of said weights which are adjustably added to a forward portion of the pedal so that the multiple weights occupy locations at opposite sides of the pedal, all of which locations are spaced from said zone.

* * * * *